US005799417A

United States Patent [19]

Burke et al.

[11] Patent Number: 5,799,417

[45] Date of Patent: Sep. 1, 1998

[54] SHOE SOLE WITH REMOVAL INSERT

[75] Inventors: Robert Burke, Barrie; James Russell, Markham; Gad Shaanan, Montreal; Walter Francovich, Pierrefonds; Ivan Brousseau, Montreal, all of Canada

[73] Assignee: Bata Limited, Toronto, Canada

[21] Appl. No.: 783,830

[22] Filed: Jan. 13, 1997

[51] Int. Cl.[6] ..... A43B 13/12; A43B 13/18

[52] U.S. Cl. ..... 36/105; 36/28; 36/30 R

[58] Field of Search ..... 36/105, 28, 30 R, 36/35 R

[56] References Cited

U.S. PATENT DOCUMENTS

| | | |
|---|---|---|
| 4,316,335 | 2/1982 | Giese et al. . |
| 4,624,061 | 11/1986 | Wezel et al. . |
| 4,674,204 | 6/1987 | Sullivan et al. . |
| 4,897,936 | 2/1990 | Fuerst . |
| 4,942,677 | 7/1990 | Flemming et al. . |
| 5,127,170 | 7/1992 | Messina . |
| 5,152,081 | 10/1992 | Hallenbeck et al. . |
| 5,175,946 | 1/1993 | Tsai . |
| 5,187,883 | 2/1993 | Penney . |
| 5,212,878 | 5/1993 | Burke et al. . |
| 5,343,637 | 9/1994 | Schindler . |
| 5,410,821 | 5/1995 | Hilgendorf . |
| 5,533,280 | 7/1996 | Halliday . |

FOREIGN PATENT DOCUMENTS

| | | |
|---|---|---|
| 1323755 | 11/1993 | Canada . |
| WO95/05099 | 2/1995 | WIPO . |

*Primary Examiner*—Ted Kavanaugh
*Attorney, Agent, or Firm*—Birch, Stewart, Kolasch & Birch, LLP

[57] ABSTRACT

A sport shoe having an upper, a sole having at least an outer sole having a mobile portion at least at the heel portion of the sole which is pivotable about a lateral axis forward of the heel portion. A midsole insert member is insertable between the mobile portion and the upper. The mobile portion includes upper engaging projections cooperating with the upper to prevent the midsole insert from moving laterally relative to the upper when the midsole insert member is introduced between the mobile portion and the upper.

25 Claims, 2 Drawing Sheets

10
12
44
33
38
38
46
24
20
42
30
30
14
18
16

38
44
12
20
22
48
29
42
32
33
32
46
27
26
31
42
33
24
28
30
33
14

SHOE SOLE WITH REMOVAL INSERT

BACKGROUND OF THE INVENTION

1. Field of the Invention

The present invention relates to sport shoes, and more particularly, to replaceable inserts for the sole of a sport shoe.

2. Description of the Prior Art

The sport shoe has reached a high level of development in the last twenty years. The basic running shoe, including a relatively soft upper and elastomeric sole, has been fine-tuned to a great degree of specialization. A specific shoe is now available for every sport. Within the sport of running, different designs can be found, whether for jogging or running marathons. Within such specialization, a different shoe can be found for a heavy male runner or for a light female runner. A sole design can also be found for someone who requires support against over-supination or over-pronation.

Such specialization of sport shoe designs has led to a large spectrum of different shoes. For instance, if an amateur runner wishes to go for a light jog of only a few kilometers, he cannot wear his pair of running shoes designed for racing. The heel cushion in the racing shoes will have a greater durometer hardness because the shock to be absorbed will be naturally greater than what is required for a light run. In the latter case, the runner will experience some discomfort since the heel will appear to be too hard. Likewise, a softer heel portion of the heel will seem too soft for a hard competitive run.

In order to satisfy all different types of running, a person would need to own several pairs of running shoes, much like a golfer requires a set of different clubs for use with different approach shots. However, running shoes are relatively expensive, and such a solution is not practical for the average runner.

Replaceable sole inserts have been contemplated for sport shoes. Examples of such shoes are described in U.S. Pat. No. 4,624,061, issued Nov. 25, 1986 to Wezel et al; U.S. Pat. No. 4,942,677, issued Jul. 24, 1990 to Flemming et al; U.S. Pat. No. 4,897,936, issued Feb. 6, 1990 to Fuerst; and U.S. Pat. No. 5,533,280, issued Jul. 9, 1996 to Halliday.

The above patents describe various methods of replacing different inserts in the sole of a shoe. In particular, U.S. Pat. No. 4,942,677 describes the use of damping plates in the heel portion of the sole for the purposes of damping the shock absorbing characteristics of the shoe. This patent includes an outsole hinged to the remainder of the sole, and wedge-shaped damping elements are inserted between the outer sole and the upper to provide proper damping or spacing in order to enhance the height of the person wearing the shoe.

U.S. Pat. No. 4,942,677 shows a structure that is best suited for more rigid dress shoes, not modern day sport shoes. Sport shoes generally have a much softer construction. A sport shoe sole constructed with a heel and replaceable insert as found in U.S. Pat. No. 4,942,677 would tend to be plagued with lateral instability since there is no structure illustrated in the patent to resist the shear forces that might occur in a more violent side sliding movement, such as in basketball or tennis.

SUMMARY OF THE INVENTION

It is an aim of the present invention to provide an improvement to the type of sport shoe construction that permits replaceable sole inserts.

It is a further aim of the present invention to provide a sport shoe construction that includes a removable heel insert with improved lateral stability.

It is a further aim of the present invention to provide a sport shoe with a sole having a heel with a replaceable insert that is easily manipulated for a quick change of inserts.

A construction in accordance with the present invention includes a sport shoe having an upper, a sole, at least an outer sole, comprising a toe portion, a metatarsal portion, and a heel portion, the outer sole having a mobile portion at least at the heel portion of the sole being pivotable about a lateral axis, a midsole insert member insertable between the mobile portion and the upper, the mobile portion including upper engaging projections cooperating with the upper to prevent the midsole insert from moving laterally relative to the upper when the midsole insert member is introduced between the mobile portion and the upper.

More specifically, attachment means are provided to secure the mobile portion to the inner sole and sandwich the midsole insert therebetween, and cooperating projections extending between the mobile portion and the midsole insert to restrain at least the mobile portion against lateral movement.

In a more specific embodiment of the present invention, the midsole insert and the outer mobile sole member each have upstanding side walls which, when in place, abut against the upper to provide lateral stability to the midsole insert and the outer mobile sole portion.

In a yet more specific embodiment of the present invention, the upper and the midsole insert include cooperating ribs and grooves having longitudinal components so as to enhance the lateral stability of the midsole insert and the upper when the midsole insert is assembled.

Thus, it can be seen that the construction of the present invention has improved stability, and particularly lateral stability, as compared to the prior art. All of the components that can move, such as the midsole insert and the outer mobile sole portion, have upward projections when assembled, including side walls, which overlap one another against the sides of the upper to provide lateral stability.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 4:
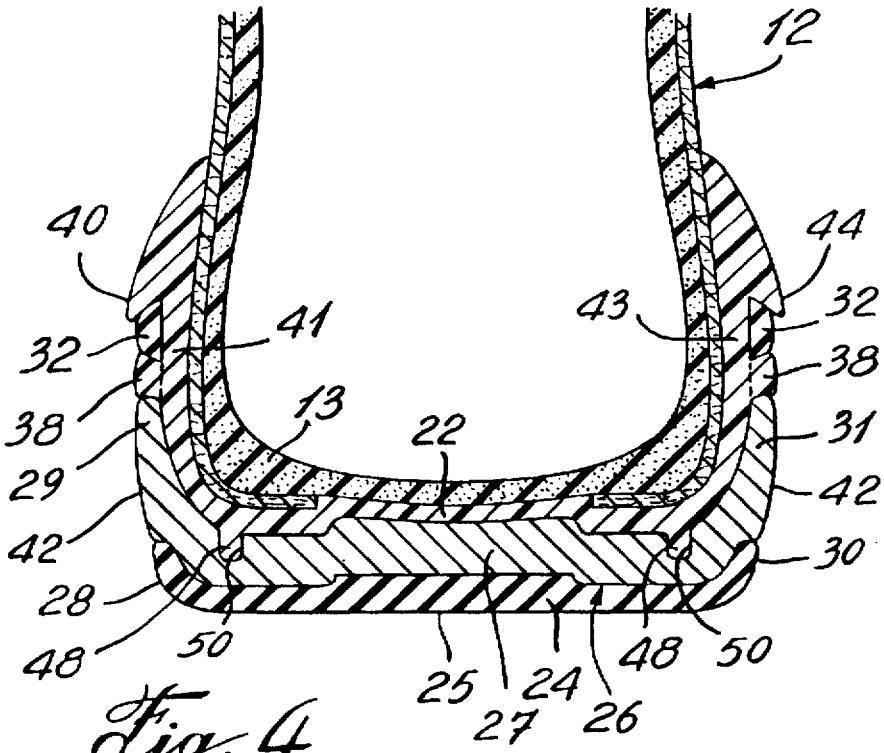
FIG. 4 is a vertical cross-section, taken along line 4—4 of FIG. 3.

The drawings show a typical sport shoe 10. The sport shoe 10 has an upper 12, a sole 14, and an inner liner 13, as seen in FIG. 4. Generally, the sport shoe has a toe portion 16, a metatarsal area 18, and a heel portion 20.

Figure 2:
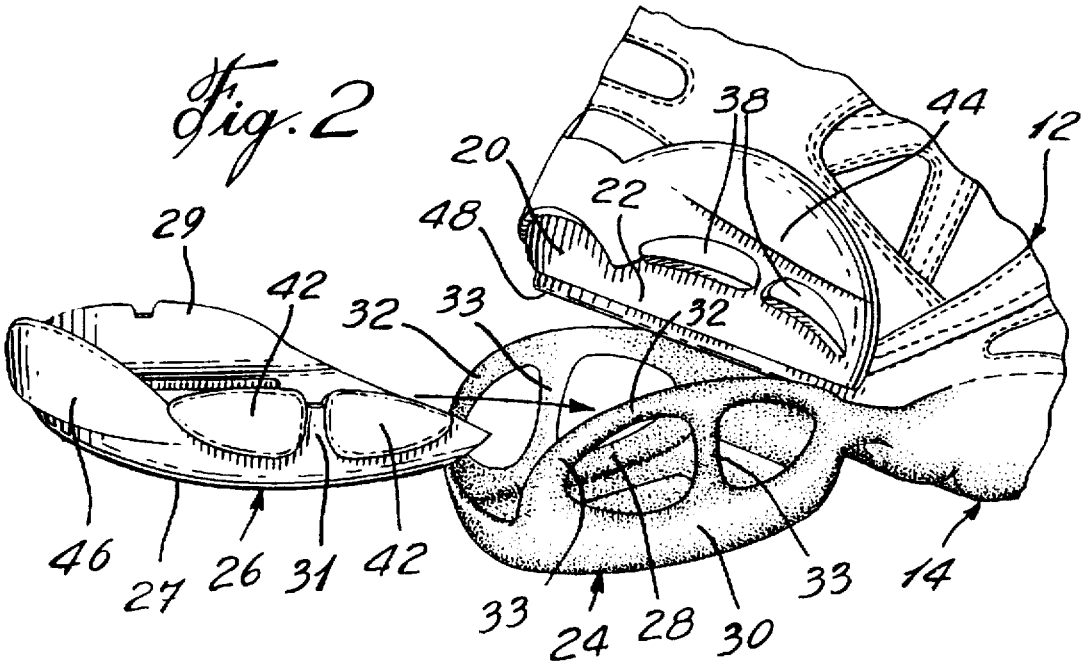
FIG. 2 is a fragmentary perspective view showing a detail of the present invention in a different operative position.

The sole 14 is made up of a heel counter 22, as seen in FIGS. 2 and 4, and a mobile outer sole segment 24, in the area of the heel 20. The remainder of the outer sole is fixed as part of the sole, and thus the mobile outer sole segment 24 is permitted to hinge about an axis extending laterally of the sole in the metatarsal area because of the flexibility of the material of the sole. The sole is generally an elastomeric material.

A midsole insert 26 is insertable at the heel 20 between the mobile outer sole 24 and the heel counter 22. The mobile outer sole 24 acts as a cage to retain the midsole insert 26 in position, as will be described.

The midsole insert 26 may vary in terms of durometer hardness depending on the weight of the user and the type of exercise contemplated. The midsole insert may be made of a polyurethane material of varying densities. Other suitable materials, such as silicone based TPR, may also be used. The midsole insert can also be formed to correct over-pronation or over-supination. In other words, the midsole insert 26 can have different thicknesses at the inner portion and outer portion thereof. It is also contemplated to have a midsole insert 26 with different damping characteristics in different areas of the midsole and could also be made of different materials with different characteristics.

The mobile outer sole segment 24 is provided with a bottom wall 25 and upstanding side wall portions 28 and 30. These upstanding side walls 28 and 30 include large openings 36 on either side wall 28 or 30. The openings 36 define upstanding columns 33 and a top member 32.

Figure 1:
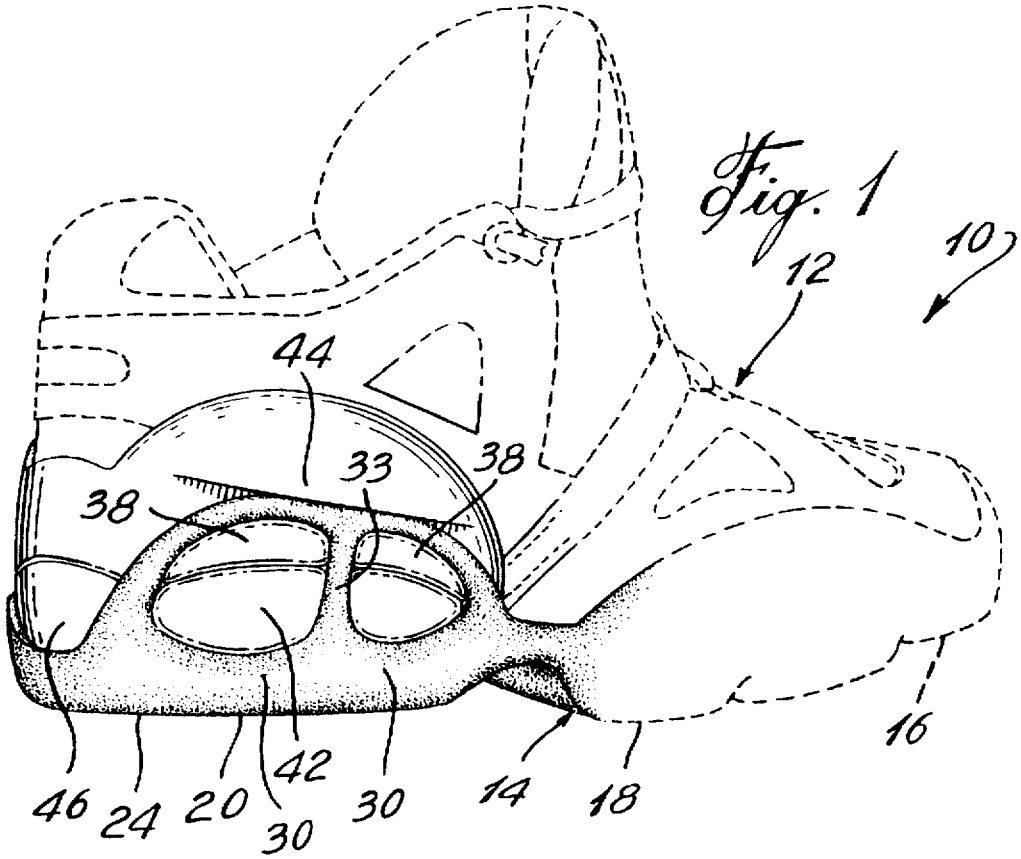
FIG. 1 is a perspective view showing a sport shoe including the present invention.
Figure 3:
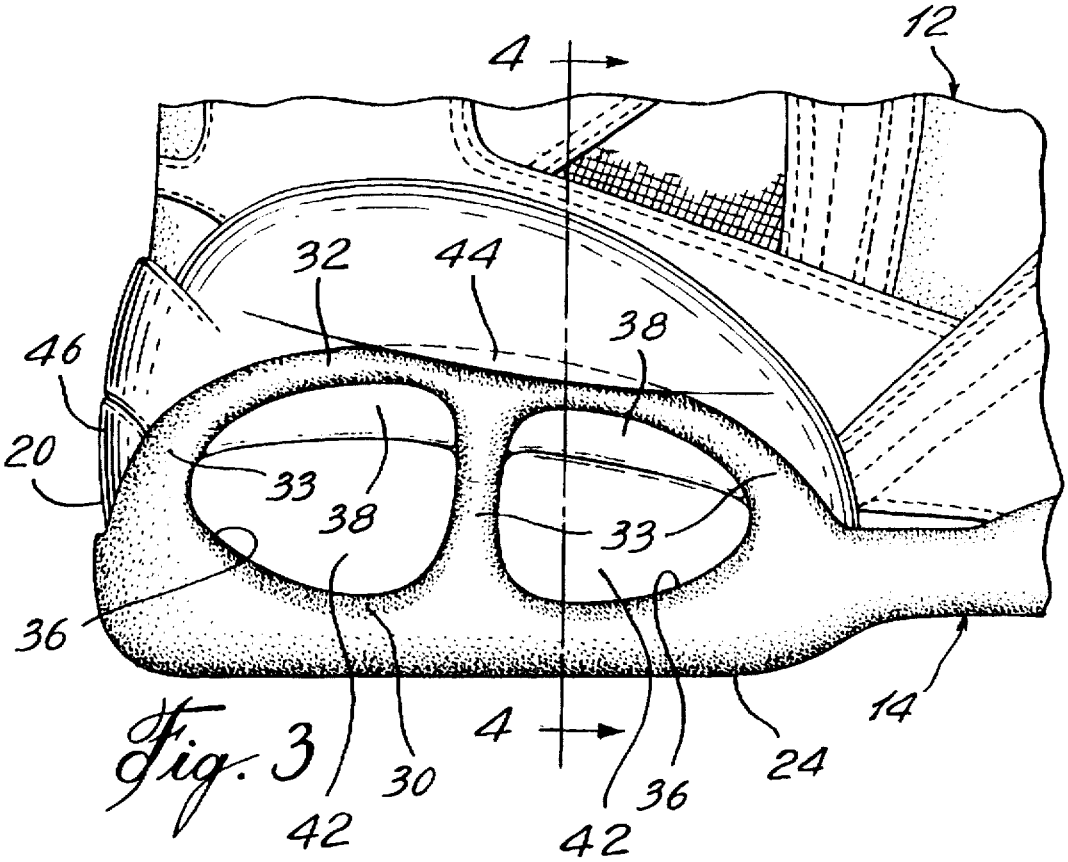
FIG. 3 is an enlarged fragmentary side elevation of the present invention.

The midsole insert 26 includes a bottom wall 27 and side walls 29 and 31. The side walls 29 and 31 have lateral projections 42 which correspond to the openings 36 in the side walls 28 and 30 of the mobile outer sole 24. In fact, the projections 42 correspond to the lower portion of the openings 36, the upper portions of these openings being filled by the ledges 38 on the upstanding side walls 41 and 43 which project upwardly from the inner sole and form the heel counter. The projections 42, 38 can be considered to be on a first location which is on both the insert 26 and the upper 12 while the openings 36 are mating holes on a second location. This second location is on the mobile portion 24. The projections 36, 42 are therefore grouped together and are inserted into the openings 36 as shown in FIGS. 1, 3 and 4. Overlapping projections 40 and 44 are also provided on the upstanding walls 41 and 43 and are adapted to overlap the top member 32 when the mobile outer sole is fixed in place. A projection 46 extends rearwardly of the midsole insert 26, as shown in the drawings, and mates with corresponding portions of the mobile outer sole 24 and the heel counter.

A U-shaped rib 48 is molded in the heel counter 22 and projects downwardly, as shown in FIGS. 2 and 4. A corresponding mating U-shaped groove 50 is defined in the bottom wall 27 of the midsole insert 26 to receive the rib 48, as shown in FIG. 4.

In operation, when it is required to provide a selected midsole insert 26, the shoe is in the position as shown in FIG. 2. Thus, the midsole insert 26 is placed between the mobile outer sole segment 24 and heel counter 22 with the rib 48 located within the groove 50. The mobile outer sole 24 would then be closed over the midsole insert 26, and the upper member 32 would be clamped into the space between the ledges 38 and the overlapping retainer members 40 and 44 respectively. Likewise, the lateral projections 42 on the upstanding side walls 29 and 31 of the midsole insert would project out of the openings 36, filling out the space of opening 36 with the ledges 38. Projection 46 would also fill out the space left at the rear of the shoe.

Thus, a secure and laterally stable assembly would result since the rib 48 engages the groove 50 in the midsole insert 26 while the midsole insert has upstanding side walls 29 and 31 abutting against the sides of the heel counter. The mobile outer sole 24 also has upstanding side walls 28 and 30 which engage against the upstanding side walls 29 and 31 of the midsole insert 26 and the side walls 41 and 43 of the heel counter.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A sport shoe having an upper, a sole having at least an outer sole, and comprising a toe portion, a metatarsal portion, and a heel portion, the outer sole having at least one mobile portion at least at the heel portion of the sole, the mobile portion is hinged about a lateral axis forward of the heel portion for movement between a closed position and an open position, an interchangeable sole insert insertable between the mobile portion, when the mobile portion is in said open position, and the upper, the mobile portion including releasable upper attachment members for releasable securing the mobile portion to complementary attachment members on the upper whereby the interchangeable sole insert will be held between the mobile portion and the upper when the mobile portion is in the closed position, and complementary convex and concave engaging projections provided on the sole insert, the mobile portion and the upper in order to prevent the sole insert from moving laterally relative to the upper when said mobile portion is in the closed position.

2. The sport shoe as defined in claim 1, wherein said complementary projections extend between the mobile portion and the sole insert and the mobile portion includes projections abutting against either side of the upper to restrain the mobile portion and the interchangeable insert against lateral movement when the mobile portion is in the closed position.

3. The sport shoe as defined in claim 2, wherein the outer sole includes a heel counter portion of the upper having upstanding walls, the attachment members including snap engagements on upstanding side wall portions on the heel counter portion, portions of the outer mobile portion being receivable in the snap engagements so as to retain the mobile portion in position sandwiching the interchangeable sole insert against the heel counter portion.

4. The sport shoe as defined in claim 3, wherein the mobile portion has upstanding side walls defining openings therein, the side walls each defining vertical members and a top member surrounding the opening, the side walls of the heel counter portion of the upper including a ledge member and a retaining member spaced upwardly from the ledge member such that, when the top member of the mobile portion is placed between the ledge member and the retaining member, the retaining member and the ledge member define a neck which is smaller than the thickness of the top member such that the top member must be snapped into the area between the ledge and the retaining member to thus lock the mobile portion in place.

5. The sport shoe as defined in claim 2, wherein said convex and concave engagement projections between the interchangeable sole insert and the upper include a rib in one of the upper and sole insert and complementary groove in the other of the upper and sole insert, wherein the rib and the groove have at least a longitudinal component relative to the shoe to resist lateral movement of the sole insert.

6. The sport shoe as defined in claim 1, wherein the interchangeable sole insert is selected from a plastics material and different interchangeable sole inserts have different densities to provide selected damping characteristics to the heel portion.

7. The sport shoe as defined in claim 6, wherein the interchangeable sole insert has a medial and a lateral portion and the medial portion includes a different thickness relative to the lateral portion in order to compensate for over-pronation or over-supination.

8. The sport shoe as defined in claim 6, wherein the interchangeable sole insert has different densities in different portions thereof for different damping characteristics in different portions of the heel portion.

9. The sport shoe as defined in claim 6, wherein the insert has different materials in different portions thereof to obtain different sole characteristics.

10. The sport shoe as defined in claim 1, wherein the convex and concave engagement projections between the upper and the mobile portion include side walls on the mobile portion extending from medial and lateral side edges of the mobile portion engaging complementary recesses defined in the respective medial and lateral sides of the upper.

11. The sport shoe as defined in claim 1, wherein the mobile portion includes upstanding side walls adapted to engage against the side walls of the upper in a heel counter portion of the upper, the attachment members including the upper heel counter portion having upstanding side wall portions with snap engagements adapted to receive portions of the upstanding side walls of the mobile portion so as to retain the mobile portion in the closed position sandwiching the sole insert against the heel counter portion and being releasable from the snap engagements for moving the mobile portion to the open position whereby the interchangeable sole insert is replaceable by another interchangeable insert.

12. The sport shoe as defined in claim 11, wherein the releasable upper attachment members on the mobile portion are at least an opening on each of the side walls of the mobile portion, the side walls defining vertical members and a top member surrounding the opening, the side walls of the heel counter portion of the upper including a ledge member and a retaining member spaced upwardly from the ledge member forming the snap engagements such that, when the top member of the mobile portion is placed between the ledge member and the retaining member, the retaining member and ledge member define a neck which is smaller than the thickness of the top member such that the top member must be snapped into the area between the ledge and the retaining member to thus lock the mobile portion in place.

13. The sport shoe as defined in claim 12, wherein the interchangeable sole insert includes lateral projections extending from the side walls thereof which engage within the opening defined in the side walls of the mobile portion in order to fill the opening along with the ledge portion.

14. A sport shoe having an upper and a sole, the shoe comprising a toe portion, a metatarsal portion and a heel portion, the sole having at least one mobile portion at least at the heel portion of the sole, the mobile portion being hinged about a lateral axis forward of the heel portion for movement between closed and open positions, an interchangeable sole insert insertable between the mobile portion and the upper when the mobile portion is in the open position, a first location being on both the insert and the upper and a second location being on the mobile portion, a plurality of projections being provided on one of the first and second locations with a mating hole being defined in the other location of the first and second locations, the projections being insertable into the mating hole to thereby hold the mobile portion in the closed position.

15. The sport shoe as defined in claim 14, wherein the plurality of projections are mounted on the one of the first and second locations.

16. The sport shoe as defined in claim 15, wherein the plurality of projections are permanently mounted on the one of the first and second locations.

17. The sport shoe as defined in claim 14, wherein the mating hole extends through the one of the first and second locations.

18. The sport shoe as defined in claim 14, wherein the plurality of projections are at the first location and the mating hole is at the second location, both the insert and the upper having at least one of the plurality of projections thereon.

19. The sport shoe as defined in claim 14, wherein the insert is selected from a plastics material and different interchangeable sole inserts have different densities to provide selected damping characteristics to the heel portion.

20. The sport shoe as defined in claim 14, further comprising:

a rib in one of the upper and insert; and a complementary groove in the other of the upper and insert, lateral movement of the insert being resisted when the rib is inserted in the groove.

21. The sport shoe as defined in claim 14, further comprising:

a heel counter provided on the upper, the plurality of projections being at the first location with at least one of the projections being on the heel counter; and a retaining member provided on the heel counter, the retaining member being spaced upwardly from the at least one projection on the heel counter, the mating hole being defined in part by vertical members and a top member on side walls of the mobile portion, the top member of the mobile portion being snapped between the at least one projection on the heel counter and the retaining member in order to lock the mobile portion in the closed position.

22. The sport shoe as defined in claim 21, wherein the at least one projection on the heel counter and another projection on the insert are simultaneously inserted into the mating hole when the mobile portion is locked in the closed position and wherein the top member of the mobile portion is removed from between the at least one projection on the heel counter and the retaining member when the mobile portion is in the open position.

23. The sport shoe as defined in claim 14, wherein the insert has a medial and a lateral portion and the medial portion includes a different thickness relative to the lateral portion in order to compensate for over-pronation or over-supination.

24. The sport shoe as defined in claim 14, wherein the insert has different densities in different portions thereof for different damping characteristics in different portions of the heel portion.

25. The sport shoe as defined in claim 14, wherein the insert has different materials in different portions thereof to obtain different sole characteristics.

* * * * *